US005230577A

United States Patent [19]

Cox et al.

[11] Patent Number: 5,230,577

[45] Date of Patent: Jul. 27, 1993

[54] APPLICATOR FOR SOFT MATERIALS

[75] Inventors: J. Richard Cox, Elgin, Ill.; John M. B. Ford, Cordova; Doug M. Lund, Memphis; John F. McAllister, Germantown, all of Tenn.

[73] Assignee: Maybelline, Inc., Wilmington, Del.

[21] Appl. No.: 914,019

[22] Filed: Jul. 15, 1992

Related U.S. Application Data

[63] Continuation of Ser. No. 786,937, Nov. 4, 1991, abandoned, which is a continuation-in-part of Ser. No. 611,659, Nov. 13, 1990, abandoned.

[51] Int. Cl.[5] ..... A45D 40/06; A45D 40/08; A45D 40/04; A45D 40/20

[52] U.S. Cl. ..... 401/68; 401/50; 401/54; 401/70; 401/75; 401/79; 401/81

[58] Field of Search ..... 401/50, 54, 68, 70, 401/75, 79, 76, 81, 80

[56] References Cited

U.S. PATENT DOCUMENTS

| | | | |
|---|---|---|---|
| 1,879,736 | 9/1932 | Deli | 401/76 |
| 2,287,364 | 6/1942 | Wehn | 401/76 X |
| 2,488,179 | 11/1949 | Engel, Jr. | 401/54 |
| 2,979,029 | 4/1961 | Melnikoff | 401/79 X |
| 3,115,118 | 12/1963 | Anderson et al. | 401/75 |
| 3,132,743 | 5/1964 | Wolff | 401/68 X |
| 5,018,892 | 5/1991 | Krueckel et al. | 401/75 X |

FOREIGN PATENT DOCUMENTS

| | | | |
|---|---|---|---|
| 1228162 | 11/1966 | Fed. Rep. of Germany | 401/54 |
| 612389 | 8/1927 | France | 401/68 |
| 646559 | 11/1928 | France | 401/54 |
| 1196278 | 11/1959 | France | 401/75 |
| 28148 | of 1913 | United Kingdom | 401/54 |
| 956651 | 4/1964 | United Kingdom | 401/75 |

*Primary Examiner*—Steven A. Bratlie
*Attorney, Agent, or Firm*—Sherman & Shalloway

[57] ABSTRACT

An improved applicator for soft materials includes a cartridge section and a relatively rotatable body section, the soft material being contained within the cartridge section and a plunger being provided to advance the soft material. The improvement resides in providing an assembly within the applicator body to prevent the inadvertent separation of the cartridge section from the body section. In a preferred embodiment, this assembly comprises a clutch means between the rotatable body section and the plunger whereby rotation of the body is transmitted to the plunger to advance and retract the plunger and associated soft material, the clutch means being designed so as to disengage before the plunger is retracted to the point at which it would forcibly separate the cartridge from the body.

21 Claims, 8 Drawing Sheets

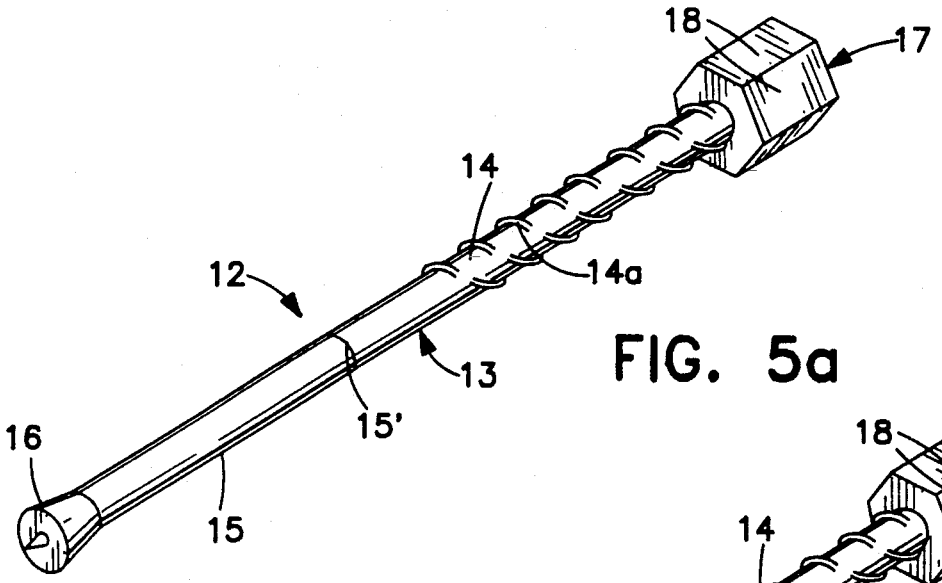
FIG. 5a
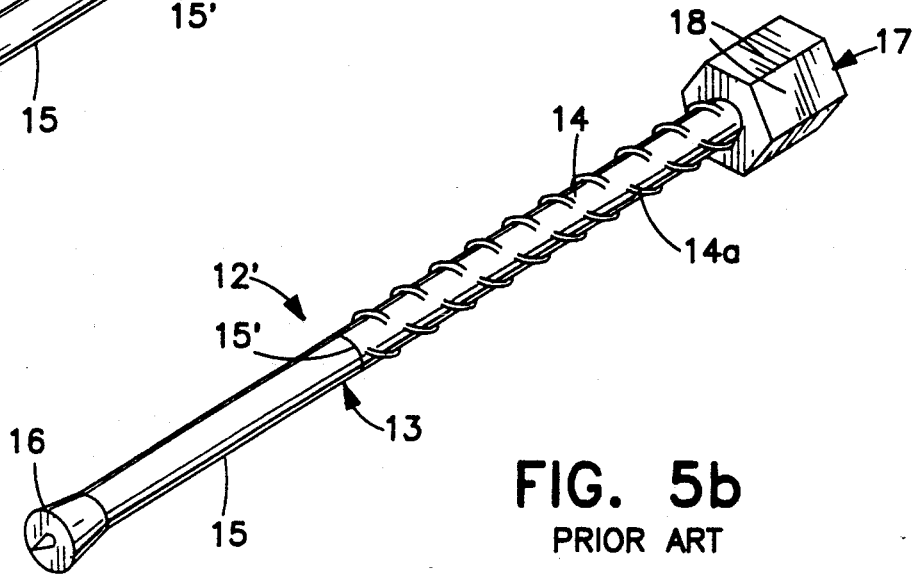
FIG. 5b
PRIOR ART
FIG. 4
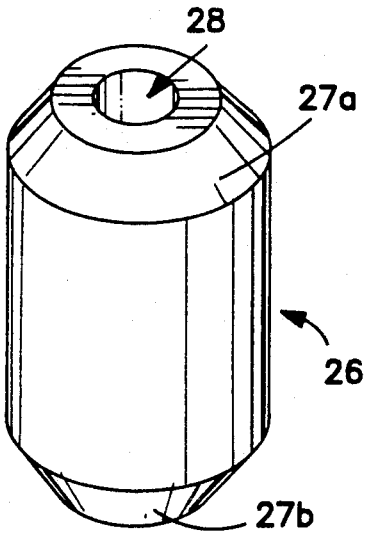
FIG. 6
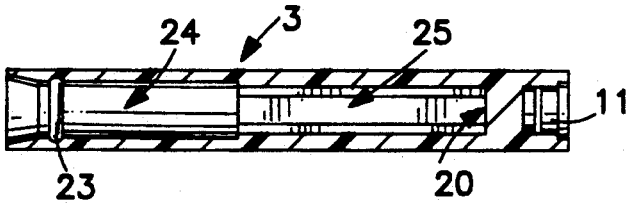

APPLICATOR FOR SOFT MATERIALS

This application is a continuation of application Ser. No. 07/786,937, filed Nov. 4, 1991, which is a continuation-in-part of application Ser. No. 07/611,659, filed Nov. 13, 1990 both abandoned.

BACKGROUND OF THE INVENTION

1. Field of the Invention

This invention relates to an improvement to an applicator for soft, moldable materials as for example, soft cosmetics, crayons, marking pens, eye liners, eye shadows, lip sticks, lip liners and the like. In particular, it relates to an improvement to such applicators that overcomes potential inoperative conditions caused by improper user activation of such applicators.

2. Description of the Prior Art

The particular applicators to which this improvement is directed are of the type which include a cartridge containing the soft, moldable material within a longitudinal bore, a cap having a pointing insert therein and a body attached to the cartridge by a retention fitting and containing a rotatable plunger or follower rod means for expelling the material. The rod threadably engages the bore of the cartridge such that rotation thereof causes it to move linearly within the cartridge to express the soft material. Generally, clockwise rotation advances the rod and the material and counterclockwise rotation retracts the rod and material. An applicator of this general type is disclosed in Published PCT application No. 88/09267, published Dec. 1, 1988, the contents of which are incorporated herein by reference.

In prior applicators of this type, it often occurs that a user may retract the plunger too far so that it bottoms out against the inner end of the applicator body. When this happens, before the threads of the rod become disengaged from the cartridge bore, the rearward force against the body overrides the retention fitting with the cartridge and causes the two pieces to separate thus rendering the item inoperative. The present invention overcomes this problem, effectively preventing excessive retraction of the rod and separation of the parts.

It is an object of this invention to provide an applicator for soft moldable materials, that overcomes the problem of the prior art.

It is a further object of this invention to provide an applicator that does not inadvertently disassemble.

Other objects and advantages of this invention will be apparent from the accompanying drawings and the following description:

SUMMARY OF THE INVENTION

The applicator of this invention includes in combination an elongated cartridge having first and second open ends with a longitudinal bore running between them. Removably securable to the first or front end of the cartridge is a hollow cap which may have an interior, conical forming surface while a hollow body is attachable to the second or rear end of the cartridge. The hollow body has a first open end and a second closed end which are connected by an inner longitudinal bore, the forward end of which is adapted to receive the rear end of the cartridge. A charge of moldable soft material such as a cosmetic is inserted into the cartridge bore and forced by a piston or rod towards the closed end of the cap, preferably into the conical surface of the cap until a conical tip is formed. The cap may then be removed exposing a shaped point of soft material supported by the cartridge and available for use. The interior surfaces of the cartridge and the cap are sufficiently smooth and non-sticking so that the charge of moldable soft material is freely slidable within the cartridge and readily releasable from the cap.

The forcing piston or rod is an elongated member that is inserted into the bore of the cartridge through the second end and is moveable by rotation to act on the charge of soft material. The rod has a first end that is flared to contact the soft material and a second end that extends out of the second end of the cartridge into the hollow body. Means are provided on the second end of the rod to engage the inner surface of the body such that rotation of the body causes the rod to rotate. A portion of the rod adjacent its second end is provided with threads that engage cooperating threads in the bore of the cartridge to convert rotation into linear movement. Preferably, clockwise rotation advances the rod into the cartridge and counterclockwise rotation retracts the rod from the cartridge into the body. The body attaches to the cartridge by means of a retention fitting, such as a cooperating annular detent and groove, to allow the body and cartridge to rotate relative to each other about a common longitudinal axis.

To overcome the problem of the prior art, the length of the threads on the threaded portion of the rod is limited and a resilient means is introduced into the body to cushion and absorb the rearward force of the retracting rod. In this manner, the force is absorbed and redirected in a spring-like manner to keep the rod threads engaged with those of the cartridge, even though the rod is fully retracted. Furthermore, limiting the thread length causes the threads to disengage before the rearward force becomes sufficient to fully compress the resilient means and force the barrel out of retention with the cartridge. Alternatively, a clutch mechanism may be included at the driving means which will provide slippage upon achieving a particular level of force thereby preventing continued retraction of the rod and subsequent separation of the body and cartridge.

BRIEF DESCRIPTION OF THE DRAWING FIGURES

Figure 1:
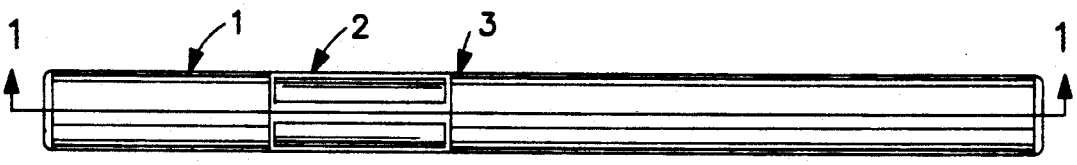
FIG. 1 is a side view of an embodiment of an applicator according to this invention.
Figure 3:
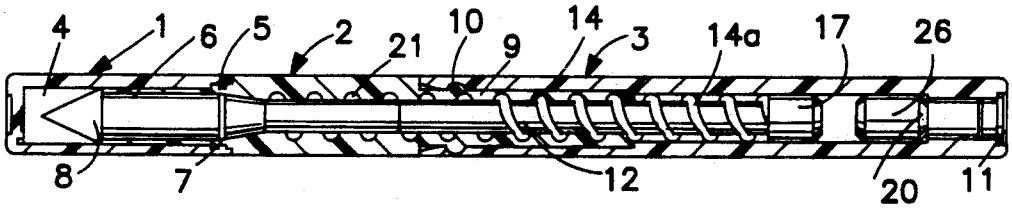
FIG. 3 is a section along line A—A of FIG. 1 showing the construction of a preferred embodiment of the present invention.
Figure 3A:
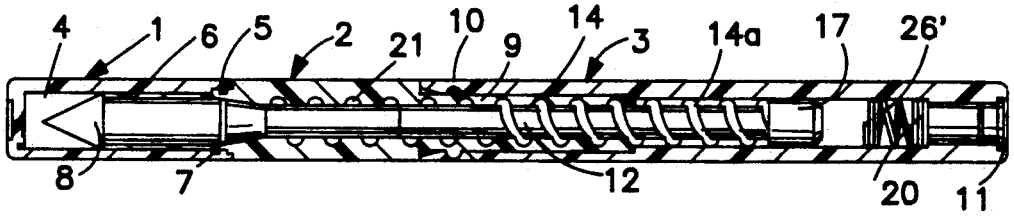
Figure 3B:
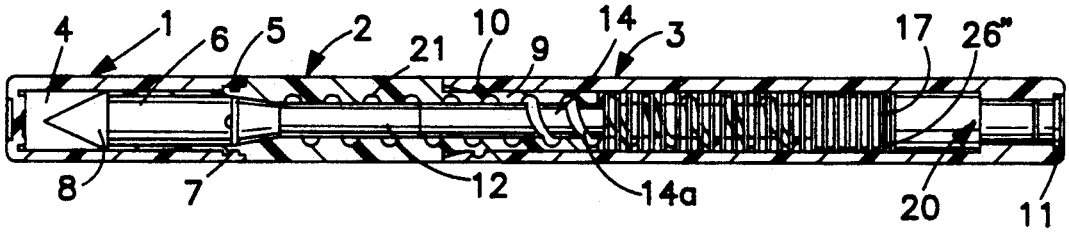
Figure 3C:
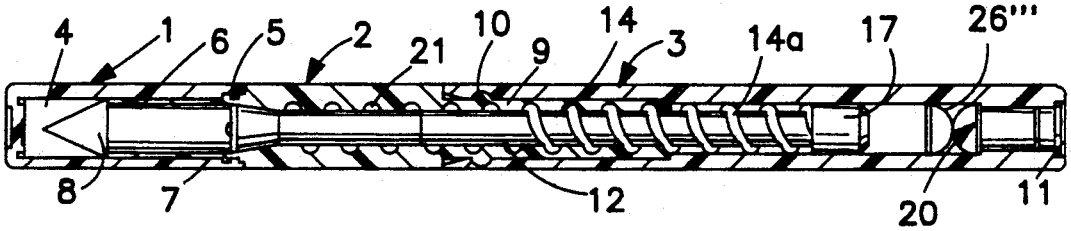
Figure 3D:
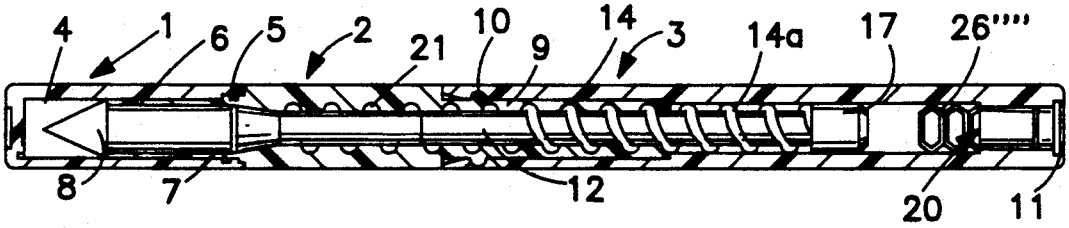
Figure 7:
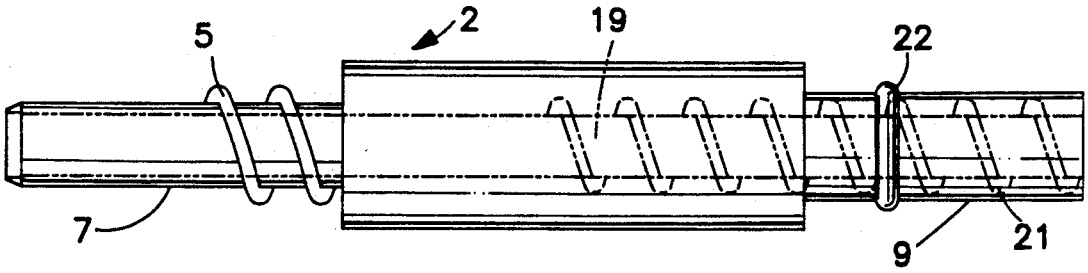
Figure 8:
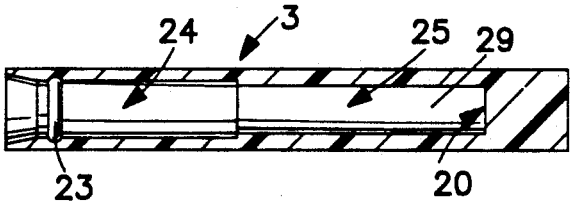
Figure 9:
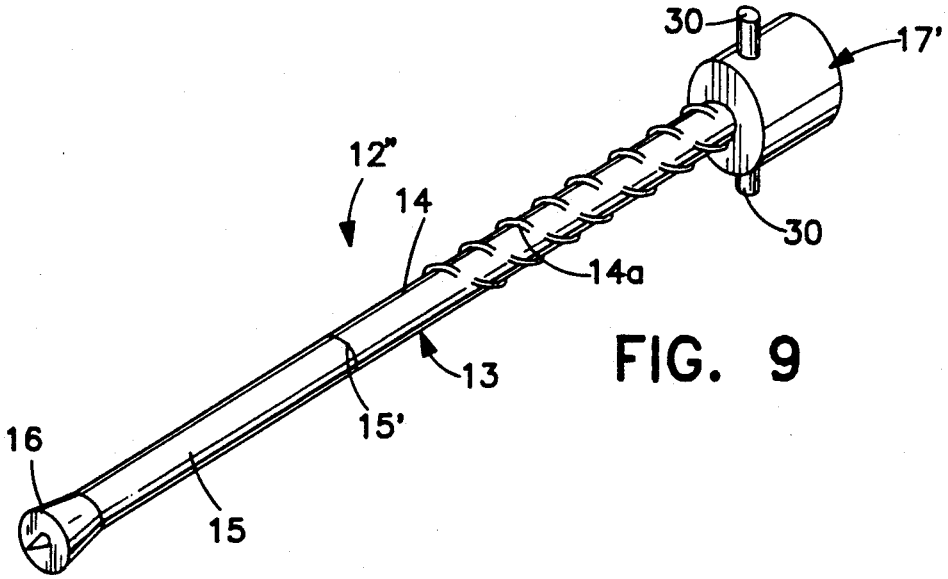
Figure 10:
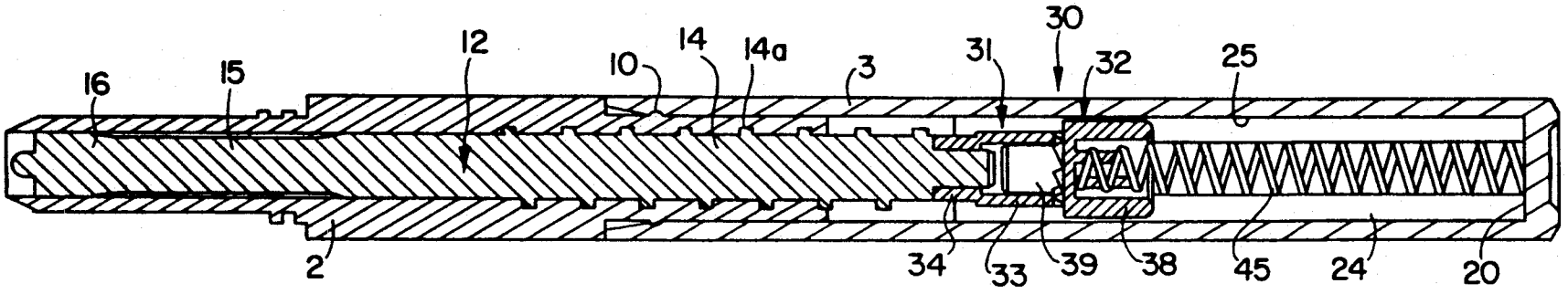
Figure 11:
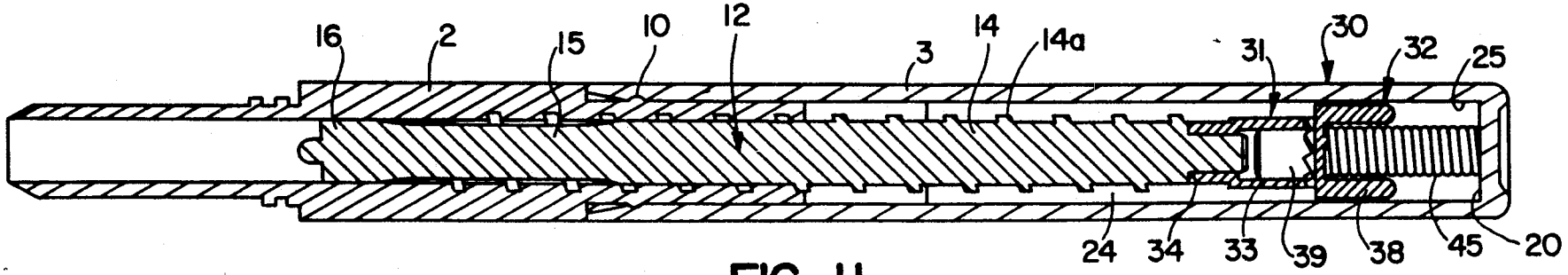
Figure 12:
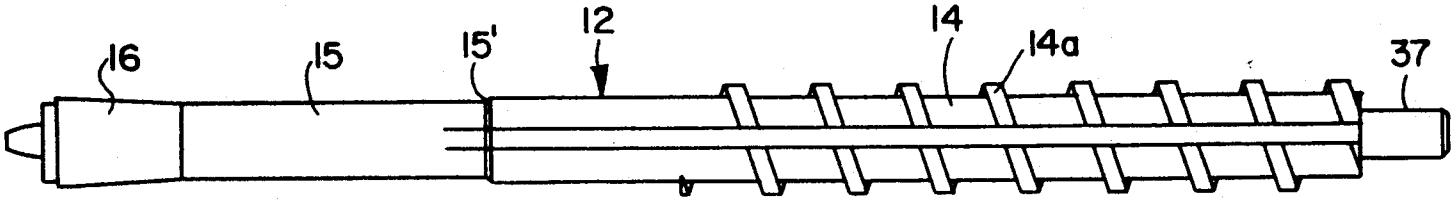
Figure 13:
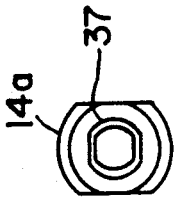
Figure 14:
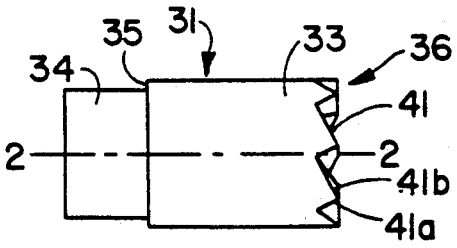
Figure 16:
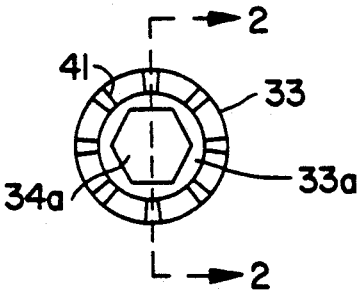
Figure 15:
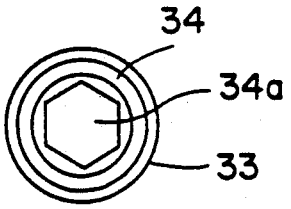
Figure 17:
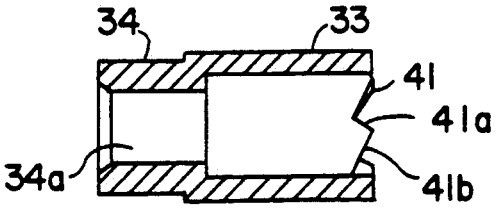
Figure 18:
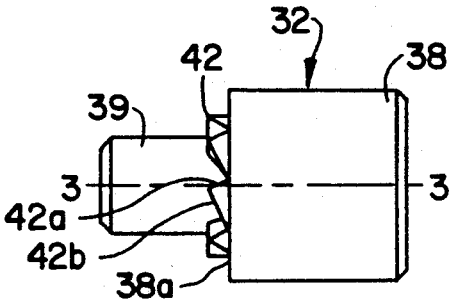
Figure 20:
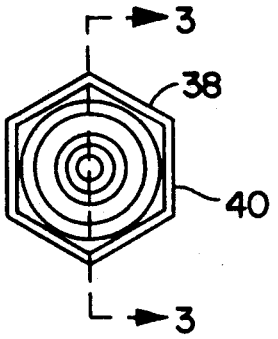
Figure 19:
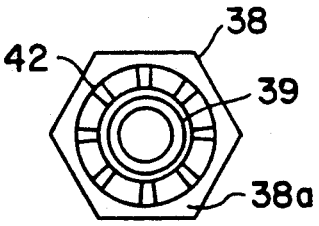
Figure 21:
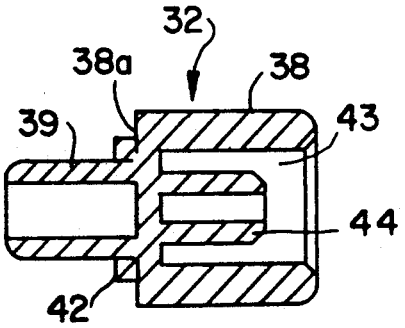

FIG. 3*a* is a section along line A—A of FIG. 1 showing the construction of a preferred embodiment of the invention with an alternative form of resilient means;

FIG. 3*b* is a section along line A—A of FIG. 1 showing the construction of another alternative embodiment of the invention;

FIG. 3*c* is a section along line A—A of FIG. 1 showing the construction of a preferred embodiment of the invention with a further alternative form of resilient means;

FIG. 3*d* is a section along line A—A of FIG. 1 showing the construction of a preferred embodiment of the invention with a still further alternative form of resilient means;

FIG. 4 is a perspective view of an embodiment of a resilient means as used in the present invention;

FIG. 5*a* is a perspective view of a plunger rod of the applicator of the invention;

FIG. 5*b* is a perspective view of a plunger rod of the prior art;

FIG. 6 is a longitudinal cross section of the applicator body along line A—A of FIG. 1;

FIG. 7 is a side view of the cartridge portion of the applicator, the bore and internal threads being shown in phantom lines;

FIG. 8 is a longitudinal cross section along line A—A of FIG. 1 of an alternative embodiment of an applicator body of this invention;

FIG. 9 is a perspective view of an alternative embodiment of a plunger rod of this invention to be used with the applicator body of FIG. 8;

FIG. 10 is a section along line A—A of FIG. 1 showing the construction of a further embodiment of the invention incorporating a clutch mechanism and illustrating the applicator in a fully extended configuration;

FIG. 11 is a section along line A—A of FIG. 1 showing the construction of the embodiment of FIG. 10 in a fully retracted configuration;

FIG. 12 is a horizontal view of an alternative embodiment of a plunger rod of the applicator as used in the construction of FIG. 10;

FIG. 13 is an end view of the rearward end of the plunger rod of FIG. 12;

FIG. 14 is a side view of an adapter portion of the clutch employed in the configuration of FIG. 10;

FIG. 15 is a forward end view of the adapter of FIG. 14;

FIG. 16 is a rearward end view of the adapter of FIG. 14;

FIG. 17 is a longitudinal cross-section of the adapter of FIG. 14 taken along line B—B;

FIG. 18 is a side view of a driver portion of the clutch employed in the configuration of FIG. 10;

FIG. 19 is a forward end view of the driver of FIG. 19; FIG. 20 is a rearward end view of the driver of FIG. 19; and FIG. 21 is a longitudinal cross-section of the driver of FIG. 19 taken along line C—C.

DETAILED DESCRIPTION OF THE INVENTION

As shown in FIG. 1, the applicator comprises three sections, the cap 1, the cartridge 2, also shown in FIG. 7, and the body 3. Looking at FIGS. 2 and 3, the cap 1 fits onto the forward end 7 of the cartridge 2 and contains a forming insert 4. Attachment of the cap 1 to the cartridge 2 is preferably by cooperating threads 5. The forming insert 4 is made separately from the cap 1 and inserted during assembly of the applicator. The insert 4 may be machined from an extruded rod of Teflon or, and more preferably, is injection molded from other suitable materials such as Celcon. The cartridge 2 has a longitudinal bore 19 therethrough in which is charged a mass of moldable, soft material, such as a cosmetic 6 which fills the forward end 7 of the cartridge 2 and is pressed against the forming insert 4 of the cap 1 so as to mold the cosmetic 6 into a smooth tapering point 8. The portion of the bore 19 in the rearward end 9 of the cartridge 2 has internal threads 21, the purpose of which is disclosed below.

Attached to the rearward end 9 of the cartridge 2 is the applicator body 3, also shown in FIG. 6. A retention fitting 10 holds the two parts together, while allowing for relative rotation of each. This retention fitting 10 preferably comprises an annular detent 22 on the rearward end 9 of the cartridge 2 and a cooperating annular groove 23 in the inner surface of the body 3. These features are shown in FIGS. 6 and 7. Preferably, the rearward portion of the inner cavity 24 of the body 3 has an internal surface 25 that is other than round. This internal surface 25 comprises a plurality of planes abutting along their long edges such that the internal surface 25 of the body 3 has a polygonal cross section. The forward portion of the inner cavity 24 is round to accommodate the rearward end 9 of the cartridge 2.

When the applicator is assembled as in FIG. 1, there is within the body 3 and extending into the cartridge 2, plunger rod 12 (see FIGS. 3 and 5*a*). As shown in FIG. 5*a*, this part comprises a shaft 13 divided into a first threaded portion 14, a second non-threaded mid-shaft portion 15, preferably of smaller diameter than the first portion 14, and a flared pushing end 16. At the base of the threaded portion 14 is driving lug 17 comprising an enlarged portion having a plurality of sides 18 that correspond to the shape of the internal surface 25 of the rearward portion of the body's inner cavity 24, the overall size of the lug 17 being slightly smaller than the inner cavity 24 to allow the plunger rod 12 to telescope therein. By forming the driving lug 17 and the rearward surface 25 of the cavity 24 in the same shape, the plunger rod 12 can be made to rotate when the body 3 is rotated and because of the cooperative threading, 14*a* and 21, of the rod 12 and cartridge 2, the rotation of the rod 12 will be converted to linear travel within the body 3 and the cartridge 2.

Alternatively, as shown in FIGS. 8 and 9, the inner cavity 24 of the body 3 may be cylindrical throughout its length with the rearward surface 25 of slightly smaller diameter. This rearward surface 25 is provided with at least one longitudinal groove 29 along its length. On the rod 12" the lug 17 corresponds to the shape of the rearward portion 25 of the inner cavity 24 and has at least one lateral cooperating member, such as the two projections 30, that travel within the longitudinal groove 29. Preferably there will be two grooves 29 diametrically opposite in the body 3 and two projections 30 arranged to fit the grooves. Such a projection and groove combination will function like the shaped lug 17 and rear portion 25 of the preferred embodiment shown in FIGS. 5*a* and 6 to transfer rotation of the body 3 to the rod 12", the longitudinal nature of the groove 29 allowing linear movement of the rod 12".

The rearmost end of the body 3 may be solidly molded as shown in FIG. 8 or, if there is an aperture, closed with a plug 11 (see FIG. 6).

When first assembled with the moldable material, preferably a cosmetic, such as eye shadow or lipstick, the driving lug 17 or 17' and most of the threaded portion 14 of the shaft 13 extend into the inner cavity 24 of the body 3. The rest of the plunger rod 12 or 12" extends into bore 19 of the cartridge 2 where the pushing end 16 engages the mass of cosmetic 6. This pushing end 16 is preferably flared to make a good but slidable fit with the bore 19 of the cartridge 2 so as to push the cosmetic 6 ahead of it.

Figure 2:
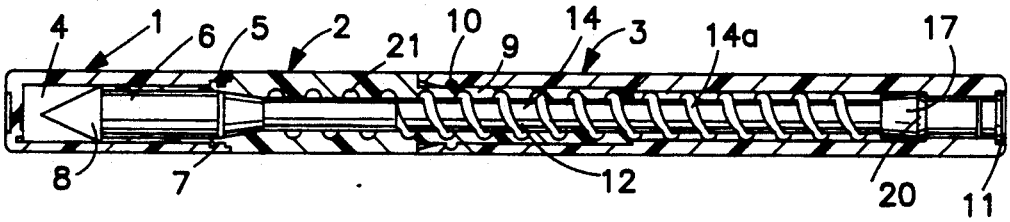
FIG. 2 PRIOR ART
FIG. 2 is a section along line A—A of FIG. 1 showing the construction of the prior art.

In applicators of the prior art, as shown in FIG. 2, the threads 14*a* on the threaded portion 14 of the plunger rod 12' extend along the shaft 13 from the driving lug 17 to the beginning of the mid-shaft 15. Such a prior art rod 12' is shown in FIG. 5*b*. Thus, when the applicator is assembled, the driving lug 17 is adjacent the bottom 20 of the inner cavity 24 of body 3 with the threads 14*a* at the forward end of threaded portion 14 engaging the inner threads 21 at the rearward end 9 of cartridge 2. In this case, rotation of body 3 in a counterclockwise direction will cause rod 12' to attempt to retract further from the cartridge 2, thus pushing against the bottom 20 of inner cavity 24 of body 3. This causes body 3 and cartridge 2 to separate at the retention fitting 10, rendering the applicator inoperative.

The applicator of the present invention, as shown in FIG. 3, is similar to the prior art, but overcomes the above-described defect in the following manner.

The plunger rod 12, as best seen in FIG. 5*a*, is modified so that the threads 14*a* extend along only part of the shaft portion 14. Thus, unlike the prior art of FIG. 5*b*, less than the full length of this portion 14 is threaded, for example $\frac{1}{2}$ to $\frac{7}{8}$, preferably $\frac{5}{8}$ to $\frac{3}{4}$, the length of portion 14 from driving lug 17 to the beginning 15' of the mid-shaft 15. By reducing the threaded length in this manner, plunger rod 12 is not bottomed out against bottom 20 when the applicator is assembled, since rod 12 extends further into bore 19 of cartridge 2 before the respective threads 14*a* and 21 engage each other. The space between driving lug 17 and the bottom 20 of body 3 is sufficient such that threads 14*a* and 21 of plunger rod 12 and cartridge 2, respectively, will disengage before lug 17 contacts the bottom 20, thus preventing the inadvertent separation of cartridge 2 and body 3.

When rod threads 14*a* disengage from the cartridge threads 21, rod 12 falls to the bottom 20 of body 3. Therefore, to reengage threads 14*a* and 21 without dismantling the applicator, the invention provides a means to reengage the threads 14*a* and 21 of rod 12 and cartridge 2 in the event rod 12 is caused to retract too far into body 3 from cartridge 2.

The reengaging means may comprise an insert 26 placed in body 3 between the bottom 20 thereof and the driving lug 17 of plunger rod 12, as shown in FIG. 3. The insert 26 may be made of a resiliently compressible, elastomeric material such as, for example, sponge rubber, neoprene or the like.

FIG. 4 illustrates a preferred embodiment of insert 26 which is substantially cylindrical with slightly frustoconical ends 27*a* and 27*b*. Having the ends in this shape facilitates introduction of the insert 26 into inner cavity 24. Although insert 26 may be solid, it is preferred that it have a longitudinal bore 28 centrally located and continuous from one end 27*a* to the other end 27*b*. It is believed that provision of such a bore 28 improves the resiliency of the insert 26 providing better spring action between the bottom 20 of body 3 and lug 17 of plunger rod 12.

When insert 26 is in place in the applicator of the invention, rotation of the body 3 relative to cartridge so as to retract the plunger rod 12 from the cartridge 2, will cause the driving lug 17 to press against the end of the insert 26. Because insert 26 is compressible, the rearward force of plunger rod 12 will be absorbed by insert as it is compressed between driving lug 17 and bottom 20 of the body 3, rather than that force being transferred to the body 3 and overcoming the retention fitting 10. Furthermore, the resilience of insert 26 is such that, when the plunger rod 12 is retracted sufficiently to disengage the threads 14*a* and 21, the insert functions as a spring to push the plunger rod 12 forward, thereby maintaining the respective threads in contact. Thus, rotation of body 3 in the opposite direction will once again advance rod 12 into the cartridge 2.

The foregoing is a preferred embodiment of the invention. Further embodiments within the scope of the following claims are deemed to be included herein. For example, in place of elastomeric material, the resilient, insert may be formed as a resiliently compressible metal or plastic spring-like member, e.g. a coiled or molded metal or plastic spring 26' such as shown in FIG. 3*a*, a molded spring 26''' of engineering plastic material such as shown in FIG. 3*c*, or a Belleville spring 26' of steel or plastic, such as shown in FIG. 3*d*. FIG. 3*b* shows a still further embodiment in which the resilient insert rather than being a compression device placed between lug 17 and the bottom 20 of the body 3, is a tension spring 26'' secured between the rear end 9 of the cartridge 2 and lug 17 and enclosing the rod 12 within the body 3. In this manner, excessive rotation of the body 3 so as to retract rod 12 beyond the point of engagement of the threads 14*a* and 21, places tension on spring 26'' so that it will pull the rod forward to reengage the threads 14*a* and 21. This embodiment preferably employs the projection 30 and groove 29 means shown in FIGS. 8 and 9 to effect cooperation between the rod 12 and the body 3. In either case the springs, whether compression or tension springs, must have sufficient memory to fully return to their unstressed condition and may be tempered. Also, the shape of the forming insert 4 may be rounded rather than conical, or the forming insert may be entirely omitted.

In a further embodiment, shown in FIGS. 10 and 11, a clutch mechanism 30 is employed at the end of the rod 12 to prevent the inadvertent separation of cartridge 2 from body 3. With this clutch mechanism 30, the extent of threads 14*a* along shaft portion 14 of rod 12 is not critical. Clutch mechanism 30 comprises two parts, an adapter 31 and a driver 32 each having cooperating detents whereby rotation of one part is imparted to the other part until a certain degree of rotational tension is reached at which point friction between the detents is overcome and the parts may rotate relative to each other. These parts are shown in FIGS. 14–17 and FIGS. 18–21 respectively.

Referring to FIGS. 14–17, adapter 31 comprises two sections, a larger, cylindrical driver engaging section 33 and a smaller cylindrical rod engaging section 34. Rod engaging section 34 extends from a forward end 35 of driver engaging section 33 along a common center line and preferably has an outside diameter which is smaller than that of driver engaging section 33. Adapter 31 is hollow, as shown in FIG. 17, each section 33 and 34 having inside diameters whose relationships are commensurate with that of the outside diameters of the sections. Thus, the inside diameter of driver engaging section 33 is preferably larger than the inside diameter of rod engaging section 34. Turning now to FIGS. 18–21, driver 32 comprises a driving lug portion 38 and an adapter engaging portion 39. Adapter engaging portion 39 is cylindrical and extends from the forward end of driving lug portion 38 along a common center line and has an outside diameter equal to or slightly smaller than the inside diameter of driver engaging section 33 of adapter 31. As shown in FIGS. 10 and 11, adapter engaging portion 39 of driver 32 fits into the hollow cylindrical interior 33*a* of driver engaging section 33 of adapter 31. By making the outside diameter of adapter engaging portion 39 the same as or slightly smaller than the inside diameter of driver engaging section 33, adapter 31 and driver 32 will be able to rotate relating to each other.

Driving lug portion 38 corresponds to driving lug 17 and, like lug 17, comprises an enlarged portion having a plurality of sides 40 and corresponds to the shape of the interior surface 25 of the rearward portion of the body's inner cavity 24, the overall size of driving lug portion 38 being slightly smaller than the inner cavity 24 to allow it to move longitudinally therein. As with the previous embodiments, forming driving lug portion 38 and the rearward surface 25 of the cavity 24 in the same shape will cause driver 32 to rotate when the body 3 is rotated.

Driving lug portion 38 is further characterized by having an interior cavity 43 which is open at the rearward end of driving lug portion 38. Centrally located within cavity 43 and extending coaxially there within is a pin 44 which provides a means for mounting a compression spring 45 within cavity 43. Spring 45 is preferably a coil spring having an inner diameter to fit over pin 44 and, as shown more clearly in FIG. 10, this spring 45 extends between driver 32 and bottom 20 of inner cavity 24 of body 3. In this manner spring 45 provides sufficient tension against driver 32 to maintain driver 32 and adapter 31 in operative contact.

As shown in FIGS. 10 and 11, adapter 31 fits on the rearward end of rod 12 and adapter engaging rod 39 of driver 32 fits into driver engaging portion 33 of adapter 31 to form a complete rod and driving mechanism. Toward this end, rod 12 instead of having driving lug 17 on its rearward end is modified as shown in FIG. 12 to have an attachment pin 37 of reduced diameter. Pin 37 fits into the hollow center of rod engaging section 34 and is affixed therein by friction or a suitable adhesive or cement. Since it is intended that adapter 31 and rod 12 rotate together, pin 37 and the interior 34*a* of rod engaging section 34 may be formed so as to have cooperating cross sections that are other than circular. Cooperating hexagonal configurations are preferred as shown in FIGS. 13 and 15. In contrast, adapter 31 and driver 32 must be free to rotate separately of each other when necessary; accordingly, the interior 33*a* of driver engaging section 33 has a circular cross section as shown in FIG. 16.

Adapter 31 and driver 32 cooperate in a clutch fashion to provide driving motion to rod 12 for extension and retraction thereof while having the ability to release from each other during retraction upon reaching a particular level of rotational tension. This is accomplished by the cooperating detents which allow slippage of the driver 32 relative to adapter 31 in one direction upon reaching the particular tension level while providing positive connection in the opposite direction. Such cooperating detents preferably take the form of circular arrays of cooperating teeth 41 and 42 on the adapter 31 and driver 32 respectively.

The teeth 41 of adapter 31 are cut into the end 36 of driver engaging section 33 while the teeth 42 of driver 32 are located on the forward face 38*a* of driving lug portion 38 and form a ring around the base of adapter engaging portion 39. Preferably both sets of teeth 41 and 42 comprise eight equally spaced teeth with each tooth comprising an acute and an obtuse surface, 41*a* and 41*b* for adapter teeth 41 and 42*a* and 42*b* for driver teeth 42. Preferably the acute surfaces 41*a* and 42*a* have an angle of 15° relative to the tooth apex, and the obtuse surfaces 41*b* and 42*b* have an angle of 75° relative to the apex, thus each tooth has one short face 41*a* and 42*a* and one long face 41*b* and 42*b*. The arrangement of the teeth 41 on adapter 31 and teeth 42 on driver 32 are such that clockwise rotation of driver 32 will cause short faces 42*a* of driver teeth 42 to butt against short faces 41*a* of adapter teeth 41 thereby transferring rotation to adapter 31 and rod 12. Such clockwise rotation will preferably cause extension of rod 12. Conversely, counter clockwise rotation of driver 32 will cause long faces 42*b* of driver teeth 42 to butt against long faces 41*b* of adapter teeth 41 and, under normal conditions, transfer rotation to adapter 31 and rod 12 thereby causing retraction of rod 12. Under normal retraction there is sufficient friction between the long faces 41*b* and 42*b* to permit transference of rotation. However, the angular relationship of these faces is such that this engagement will slip upon reaching a certain level of rotational tension such as when spring 45 reaches nearly full compression on retraction of rod 12. When this occurs, the angle of long faces 41*b* and 42*b* is such that the relative friction between those faces is overcome and driver teeth 42 are able to ride over adapter teeth 41 upon continued rotation of driver 32. At this point there is preferably sufficient free play between the parts of the apparatus to allow the necessary longitudinal displacement of driver 32 and adapter 31 so that driver teeth 42 may ride over adapter teeth 41. Alternatively, adapter 31 and driver 32 may be made of a material which allows partial compression of their respective teeth 41 and 42. This may be combined with an alternative design of teeth 41 and 42 wherein short faces 41*a* and 42*a* are undercut to facilitate compression from force applied to long faces 41*b* and 42*b*.

Such relative slippage of the clutch parts, adapter 31 and driver 32, upon full retraction of rod 12 functions to prevent the inadvertent separation of cartridge 2 and body 3 at retention fitting 10 by allowing the parts 31 and 32 to slip relative to each other rather than continue to retract rod 12 which would force cartridge 2 and body 3 apart. While the foregoing is a preferred embodiment of a clutch mechanism to be employed in such applicators, other embodiments within the scope of the following claims are deemed to be included herein. For example, driver 32 and adapter 31 may be made from materials having particular coefficients of friction that allow cooperative frictional engagement therebetween to be overcome at a particular rotational tension level whereby adapter 31 and driver 32 will slip relating to each other. Alternatively, the cooperative detents exemplified by teeth 41 and 42 may have different forms such as cooperating bumps or bumps and depressions on the contacting faces 36 and 38*a* of adapter 31 and driver 32 respectively.

Still other embodiments and modifications within the spirit and scope of the foregoing description and appended claims will become apparent to those of skill in the art after reviewing this application.

What is claimed is:

1. In an applicator for dispensing a moldable soft material, comprising an elongated cartridge having a first end, a second end and a longitudinal through bore adapted to receive a charge of moldable soft material and having threads along a portion thereof inward from said second end; a cap threadably removable from said first end of said cartridge; an elongated body having a first open end, a second closed end and a longitudinal bore therebetween, said first open end adapted to receive said second end of said cartridge in relative rotational attachment, said cartridge and said body adapted for relative rotation about a common longitudinal axes, an elongated rod having a first end insertable into the bore of said cartridge from said second end of said cartridge and a second end extending from said second end of said cartridge into the bore of said body, said rod having threads cooperating with said threads within said cartridge bore and means at said second end of said rod cooperating with said bore of said body to cause said rod to rotate and move linearly in response to rotation of said body; the improvement comprising: clutch means at said second end of said rod cooperating with said rod and the bore of said body to provide rotational connection between said body and said rod, said clutch means being capable of disengaging said rotational connection in response to excess tension; whereby, rotation of said body in one direction advances said rod into said cartridge and rotation in an opposite direction retracts said rod from said cartridge into said body, whereby continued retraction of said rod into said body results in a build-up of tension in said clutch means to a point whereby said clutch means disengages thereby preventing further retraction of said rod, said disengagement occurring at a point prior to complete retraction of said rod.

2. The applicator of claim 1, wherein said clutch means comprises an adapter and a driver, said adapter comprising a first end having means for non-rotational attachment to said second end of said rod and a second end rotationally connectable to said driver, and said driver comprising a first end having means for rotational connection to said adapter and a second end cooperating with said bore of said body, said driver and said adapter having means for frictional connection therebetween.

3. The applicator of claim 2 wherein said means for frictional connection comprises cooperating detent means.

4. The applicator of claim 3 wherein said cooperating detent means comprises a first set of teeth on said second end of said adaptor and a second set of teeth on said first end of said driver, said teeth cooperative to transmit rotation from said driver to said adapter and having a frictional relationship which can be overcome in at least one direction of rotation.

5. The applicator of claim 4 wherein each of teeth comprises a short face having a steep angle and a long face having a shallow angle, said first and second sets of teeth being positioned on said adapter and driver respectively such that, when said adapter and driver are cooperatively connected, said short faces of said first set of teeth abut said short faces of said second set of teeth during rotation to advance said rod and said long faces of said first set of teeth abut said long faces of said second set of teeth during rotation to retract said rod.

6. The applicator of claim 5 further comprising resilient compressible means disposed within said bore of said body, between and in contact with said driver and said closed end of said body, whereby said driver is maintained in frictional connection with said adapter, provided that said frictional connection may be overcome prior to complete retraction of said rod whereby said driver is caused to rotate apart from said adapter by release of said frictional connection.

7. The applicator of claim 2 wherein said second end of said driver comprises means cooperative with said bore of said body whereby rotation of said body about its longitudinal axis is transmitted to said driver and, through said frictional connection means, to said adapter and said rod attached thereto.

8. The applicator of claim 7 further comprising means to maintain said driver in contact with said adapter.

9. The applicator of claim 8 wherein said means to maintain said driver in contact with said adapter comprises a resilient compressible means disposed within said core of said body between said driver and said closed end of said body.

10. The applicator of claim 2 wherein said adapter has a longitudinal through bore having a cylindrical cross section in at least said second end of said adapter and said means for rotational connection of said driver to said adapter comprises a cylindrical portion of reduced diameter extending longitudinally from said first end and insertable in said bore of said second end of said adapter, said means for frictional connection comprising said second end surface of said adaptor and said first end surface of said driver circumferentially about said cylindrical portion.

11. In an applicator for dispensing a moldable soft material, comprising an elongated cartridge having a first end, a second end and a longitudinal through bore adapted to receive a charge of moldable soft material and having threads along a portion thereof inward from said second end; a cap threadably removable from said first end of said cartridge; an elongated body having a first open end, a second closed end and a longitudinal bore therebetween, said first open end adapted to receive said second end of said cartridge in relative rotational attachment, said cartridge and said body adapted for relative rotation about a common longitudinal axis; an elongated rod having a first end insertable into the bore of said cartridge from said second end of said cartridge and a second end extending from said second end of said cartridge into the bore of said body, said rod having threads cooperating with said threads within said cartridge bore and means at said second end of said rod cooperating with said bore of said body to cause said rod to rotate and move linearly in response to rotation of said body; the improvement comprising: said rod comprising a flared head at said first end, a reduced diameter mid-section, and a rear section adjacent said second end, said threads on said rod being limited to and covering less than the full length of said rear section from said cooperating means forward a distance of from $\frac{1}{2}$ to $\frac{7}{8}$ the length of said rear section, and resilient means within the bore of said body between the second end of said rod and the closed end of said body, said threads on said rod extending over only a portion of the length of said rod such that said threads will disengage from the threads of said cartridge bore when said rod is moved linearly into said body before the second end of said rod fully compresses said resilient means; whereby, rotation of said body in one direction advances said rod into said cartridge and rotation in an opposite direction retracts said rod from said cartridge into said body, whereby continued retraction of said rod into said body causes said second end of said rod to contact and compress said resilient means, said resilient means absorbing the linear force of retraction, and whereby the threads on said rod are of a length to disengage from the threads in the bore of said cartridge before said resilient means is fully compressed, the stored energy in said compressed resilient means tending to urge said rod forward to reestablish engagement of said threads.

12. The applicator of claim 11, wherein said resilient means comprises a substantially cylindrical insert having a length to substantially fill the area within the body between the second end of the rod and the closed end of the body when said applicator contains a full charge of moldable soft material.

13. The applicator of claim 12, wherein said insert is made of an elastomeric material.

14. The applicator of claim 11, wherein said resilient means is a metal or plastic spring.

15. The applicator of claim 11, wherein said means at said second end of said rod cooperating with the bore of said body comprises a lug having a plurality of sides, said bore of said body having an internal surface comprising an equal number of sides.

16. The applicator of claim 11, wherein said means at said second end of said rod cooperating with said bore of said body comprises a least one lateral projection adapted to be confined and travel in a longitudinal groove within the bore of said body.

17. The applicator of claim 11 wherein said threads extend along said rear section of said rod from said cooperating means forward a distance of from $\frac{2}{3}$ to $\frac{3}{4}$ the length of said rear section.

18. In an applicator for dispensing a moldable soft material, comprising an elongated cartridge having a first end, a second end and a longitudinal through bore adapted to receive a charge of moldable soft material and having threads along a portion thereof inward from said second end; a cap threadably removable from said first end of said cartridge; an elongated body having a first open end, a second closed end and a longitudinal bore therebetween, said first open end adapted to receive said second end of said cartridge in relative rotational attachment, said cartridge and said body adapted for relative rotation about a common longitudinal axis; an elongated rod having a first end insertable into the bore of said cartridge from said second end of said cartridge and a second end extending from said second end of said cartridge into the bore of said body, said rod having threads cooperating with said threads within said cartridge bore and means at said second end cooperating with said bore of said body to cause said rod to rotate and move linearly in response to rotation of said body; the improvement comprising: a tension resilient means within the bore of said body between the second end of said cartridge and the second end of said rod and attached thereto, said resilient means being coaxial with and enclosing said rod within said body, and the threads on said rod extending over only a portion of the length of said rod such that said threads disengage from the threads of said cartridge bore when said rod is moved linearly into said body before said resilient means is placed under full tension and before the second end of said rod contacts the closed end of said body; whereby, rotation of said body in one direction advances said rod into said cartridge and rotation in an opposite direction retracts said rod from said cartridge into said body, such that continued retraction of said rod into said body places tension on said resilient means, said means absorbing the linear force of retraction, and whereby the threads on said rod are of a length to disengage from the threads in the bore of said cartridge before said resilient means is fully tensed and before said rod contacts the closed end of said body, the stored energy in said tensed resilient means tending to urge said rod forward to reestablish engagement of said threads.

19. The applicator of claim 18, wherein said tension resilient means comprises a coiled spring of memory material.

20. The applicator of claim 18 wherein said rod comprises a flared head at said first end, a reduced diameter mid-section, and a rear section adjacent said second end, said threads on said rod being limited to and covering less than the full length of said rear section from said cooperating means forward a distance of from $\frac{1}{2}$ to $\frac{7}{8}$ the length of said rear section.

21. The applicator of claim 20 wherein said threads extend along said rear section of said rod from said cooperating means forward a distance of from $\frac{2}{3}$ to $\frac{3}{4}$ the length of said rear section.

* * * * *